US010502008B2

(12) United States Patent
Perrin et al.

(10) Patent No.: US 10,502,008 B2
(45) Date of Patent: Dec. 10, 2019

(54) STABILIZER ASSEMBLY

(71) Applicant: Schlumberger Technology Corporation, Sugar Land, TX (US)

(72) Inventors: Cedric Perrin, Clamart (FR); Didier Fouillou, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 85 days.

(21) Appl. No.: 15/531,756

(22) PCT Filed: Dec. 8, 2015

(86) PCT No.: PCT/EP2015/002471
§ 371 (c)(1),
(2) Date: May 31, 2017

(87) PCT Pub. No.: WO2016/091379
PCT Pub. Date: Jun. 16, 2016

(65) Prior Publication Data

US 2017/0268299 A1 Sep. 21, 2017

(30) Foreign Application Priority Data

Dec. 12, 2014 (EP) ..... 14290380

(51) Int. Cl.
*E21B 17/10* (2006.01)
*E21B 23/02* (2006.01)

(52) U.S. Cl.
CPC ..... *E21B 17/1078* (2013.01); *E21B 23/02* (2013.01); *E21B 17/10* (2013.01)

(58) Field of Classification Search
CPC ..... E21B 17/1078; E21B 17/1057; E21B 17/1064; E21B 17/10; E21B 23/02
See application file for complete search history.

(56) References Cited

U.S. PATENT DOCUMENTS 1,715,547 A * 6/1929 Hardesty ..... E21B 17/1057 175/325.3
2,079,142 A * 5/1937 Zublin ..... E21B 10/08 175/338

(Continued)

FOREIGN PATENT DOCUMENTS

CN 203783487 U 8/2014
GB 2338970 A 1/2000

(Continued)

OTHER PUBLICATIONS

International Search Report and Written Opinion issued in International application PCT/EP2015/002471 dated Feb. 19, 2016. 11 pages.

(Continued)

*Primary Examiner* — Nicole Coy

(57) ABSTRACT

A stabilizer assembly comprising a tubular member, a stabilizer sleeve slidably disposed about the tubular member, and a plurality of round members each disposed between the stabilizer sleeve and the tubular member. The stabilizer sleeve may comprise a plurality of round cavities each located in an inner surface of the stabilizer sleeve. Each of the plurality of round members may be disposed within a corresponding one of the plurality of round cavities. The stabilizer assembly may be coupled between opposing first and second portions of a downhole drill string.

7 Claims, 9 Drawing Sheets

(56) References Cited

U.S. PATENT DOCUMENTS

| | | | | |
|---|---|---|---|---|
| 5,711,386 | A | 1/1998 | Swietlik | |
| 6,279,669 | B1 | 8/2001 | Swietlik et al. | |
| 6,655,477 | B2 * | 12/2003 | Appleton ..... | E21B 17/046 166/241.6 |

FOREIGN PATENT DOCUMENTS

| | | | |
|---|---|---|---|
| GB | 2388970 | A | 11/2003 |
| WO | 2014168960 | A2 | 10/2014 |

OTHER PUBLICATIONS

Extended Search Report R. 62 issued in European application 14290380.6 dated Jun. 1, 2015. 5 pages.

* cited by examiner

STABILIZER ASSEMBLY

BACKGROUND OF THE DISCLOSURE

Stabilizers are used in a drill string to provide a predetermined radial spacing of the longitudinal axis of a component of the drill string with respect to the wall of the wellbore in which the drill string is disposed. A stabilizer may be either full-gauge, so that the outer diameter of its blades is substantially the same as the gauge diameter of the drill bit, or under-gauge, so that the outer diameter of its blades is less than the gauge diameter of the drill bit. The use of various combinations of full and/or under-gauge stabilizers, and the longitudinal spacing thereof along the drill string above the drill bit, is one of various methods which may be used to control the direction the wellbore takes during drilling.

One or more components of the drill string may include sensors and/or other measuring tools operable to measure a characteristic property of the formation penetrated by the wellbore. If a stabilizer is used, one or more of such sensors may be positioned underneath the blades of the stabilizer in a manner permitting a clear path for the sensor signal to reach the formation. The blades permit wellbore fluids and/or drilling debris to travel past the stabilizer while providing a measurement space or standoff that is substantially free of these and other obstructions, which otherwise may have an adverse impact on the quality of the measurement. The stabilizer may also include a window or other area transparent to sensor measurement signals emitted by the sensors located within the drill collar, thus providing a clear path for the sensor signal to reach and/or return from the formation. In such implementations, the stabilizer sleeve is axially and rotationally positioned such that the window is in front of or otherwise aligned with the sensor contained within the collar. The stabilizer sleeve is maintained in such position during drilling.

Certain slide-on stabilizers and corresponding drill collars may be mechanically compromised by fatigue and other reliability issues, and can be difficult to manufacture. For example, the slide-on stabilizers, such as keyed and spline type stabilizers, may experience high cyclic loading caused by rotation and bending while drilling, resulting in adverse wear and deformation, which may induce early catastrophic failures.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a stabilizer assembly coupled between opposing first and second portions of a downhole drill string. The stabilizer assembly includes a tubular member, a stabilizer sleeve slidably disposed about the tubular member and including at least one round cavity located in an inner surface of the stabilizer sleeve, and at least one round member disposed between the stabilizer sleeve and the tubular member, within the at least one round cavity, so as to contact both of the stabilizer sleeve and the tubular member.

The present disclosure also introduces an apparatus that includes a module for coupling between opposing first and second portions of a downhole string. The module includes a tubular member operable for coupling between the opposing first and second portions of the downhole string. The tubular member includes first cavities each extending into an exterior surface of the tubular member. The module also includes a sleeve disposed about the tubular member. The sleeve includes second cavities each extending into an internal surface of the sleeve. The module also includes discrete members each including a first portion, disposed within a corresponding one of the first cavities, and a second portion, disposed within a corresponding one of the second cavities. At least one of the first and second portions of each discrete member is substantially spherical.

The present disclosure also introduces a method that includes disposing round members within corresponding tubular cavities that each extend into an exterior surface of a tubular member. The method also includes disposing a sleeve about the tubular member such that each of the round members is further positioned within corresponding sleeve cavities that each extend into an interior surface of the sleeve, such that each round member contacts the tubular member and the sleeve.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
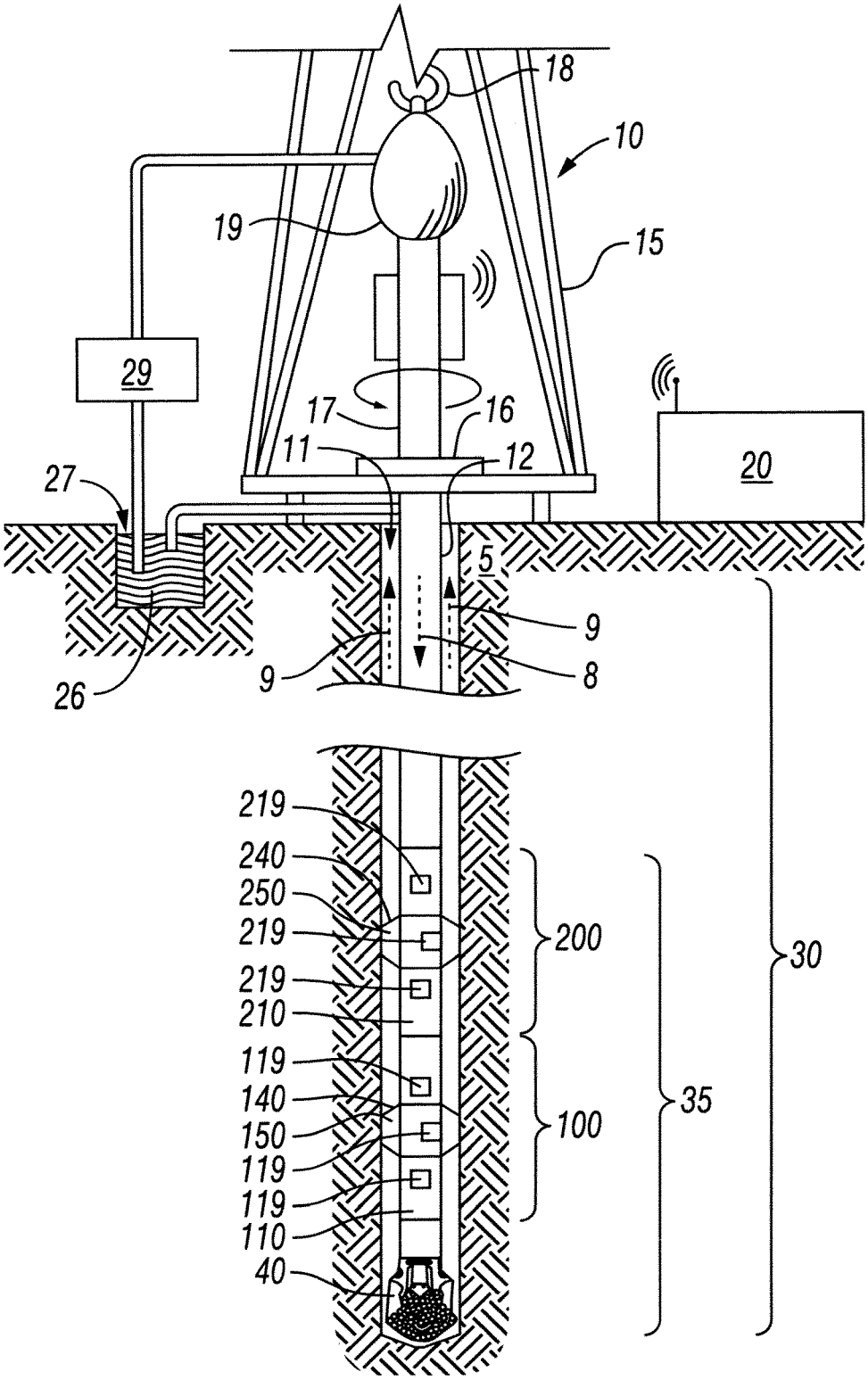
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of an example drilling system 10 that may be employed onshore and/or offshore, where a wellbore 11 may have been formed in the one or more subsurface formations 5 by rotary and/or directional drilling. As depicted, a drill string 30 may include coupled sections of drill pipe and/or other conveyance means 12 suspended within the wellbore 11 and coupled to a bottom hole assembly (BHA) 35, which may have a drill bit 40 at its lower end. The conveyance means 12 may comprise drill pipe, wired drill pipe (WDP), tough logging condition (TLC) pipe, coiled tubing, and/or other means of conveying the BHA 35 within the wellbore 11.

The surface portion of the drilling system 10 may comprise a platform, a rig, a derrick, and/or other wellsite structure 15 positioned over the wellbore 11. The drilling system 10 may further comprise a rotary table 16, a kelly 17, a hook 18, and/or a rotary swivel 19. The conveyance means 12 may be rotated by the rotary table 16, which may engage the kelly 17 at the upper end of the conveyance means 12. The conveyance means 12 may be suspended from the hook 18, which may be attached to a traveling block (not shown), and through the kelly 17 and the rotary swivel 19, which permits rotation of the conveyance means 12 relative to the hook 18. Additionally, or instead, a top drive system (not shown) may be used.

The surface portion of the drilling system 10 may also include a pit or other container 27 containing drilling fluid 26, which is commonly referred to in the industry as mud. A pump 29 may deliver the drilling fluid 26 to the interior of the conveyance means 12 via a port (not shown) in the swivel 19, causing the drilling fluid 26 to flow downhole through the conveyance means 12, as indicated by directional arrow 8. The drilling fluid 26 may exit the conveyance means 12 via ports (not shown) in the drill bit 40, and then circulate uphole through the annulus region between the outside of the conveyance means 12 and the wall of the wellbore 11, as indicated by directional arrows 9. The drilling fluid 26 may be used to lubricate the drill bit 40 and/or carry formation cuttings up to the surface as it is returned to the pit 27 for recirculation. Although not pictured, one or more other circulation implementations are also within the scope of the present disclosure, such as a reverse circulation implementation, in which the drilling fluid 26 is pumped down the annulus region (i.e., opposite to directional arrows 9) to return to the surface within the interior of the conveyance means 12 (i.e., opposite to directional arrow 8).

The BHA 35 may further comprise various numbers and/or types of drill collars 110, 210, coupled along the drill string 30 between opposing portions of the conveyance means 12 and/or the BHA 35. The drill collars 110, 210 may include various downhole sensors and/or tools 119, 219 housed therein. One or more of these downhole tools 119, 219 may be or comprise an acoustic tool, a density tool, a directional drilling tool, a drilling tool, an electromagnetic (EM) tool, a formation evaluation tool, a gravity tool, a logging while drilling (LWD) tool, a magnetic resonance tool, a measurement while drilling (MWD) tool, a monitoring tool, a neutron tool, a nuclear tool, a photoelectric factor tool, a porosity tool, a reservoir characterization tool, a resistivity tool, a seismic tool, a surveying tool, a telemetry tool, and/or a tough logging condition (TLC) tool, although other downhole tools are also within the scope of the present disclosure.

The downhole tools 119, 219 may include capabilities for measuring, processing, and/or storing information, as well as for communicating with each other and/or directly with a logging and control system and/or other surface equipment 20. Such communication may utilize one or more conventional and/or future-developed one-way or two-way telemetry systems, such as may be or comprise a mud-pulse telemetry system, a WDP telemetry system, an EM telemetry system, and/or an acoustic telemetry system, among others within the scope of the present disclosure. One or more of the downhole tools 119, 219 may also comprise an apparatus for generating electrical power for use by one or more components of the BHA 35. Example devices to generate electrical power include, but are not limited to, a battery system and a turbine generator powered by the flow of the drilling fluid.

The BHA 35 may further comprise sleeves 140, 240, such as may be operable to stabilize, centralize, and/or guide the BHA 35 along the wellbore 11 and prevent the drill collars 110, 210 from contacting the walls of the wellbore 11. The sleeves 140, 240 may be disposed about the drill collars 110, 210 and may comprise a plurality of external blades 150, 250. Each corresponding set of drill collars 110, 210, sleeves 140, 240, and downhole tools 119, 219, may collectively be referred to as first and second stabilizer assemblies 100, 200. The first and second stabilizer assemblies 100, 200 may comprise the same or similar structure and/or function. Because the first and the second stabilizer assemblies 100, 200 may comprise the same or similar structure and/or function, the first stabilizer assembly 100 is hereafter referred to herein as "the stabilizer assembly 100."

Figure 2:
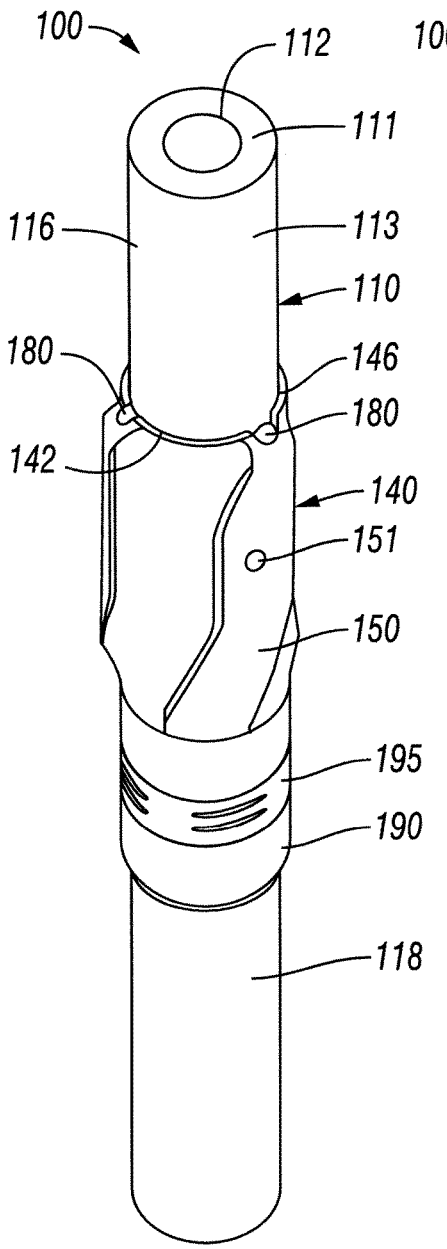
FIG. 2 is an angle view of an example implementation of a portion of the apparatus shown in FIG. 1 according to one or more aspects of the present disclosure
Figure 3:
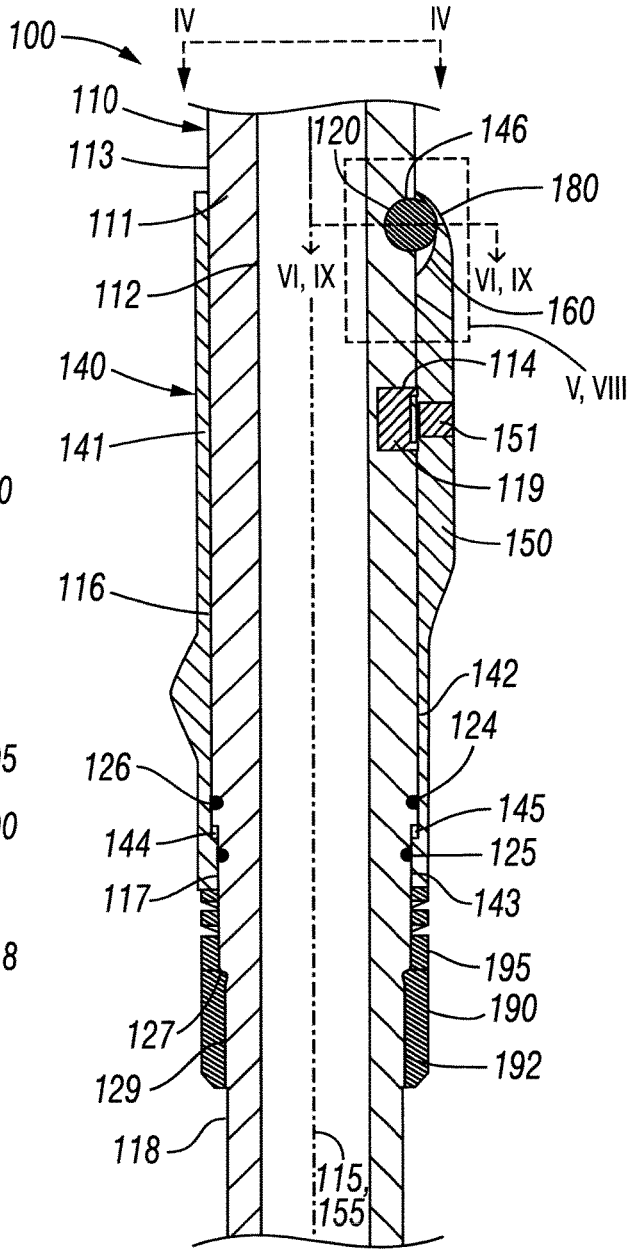
FIG. 3 is a side sectional view of a portion of the apparatus shown, in FIG. 2 according to one or more aspects of the present disclosure.
Figure 4:
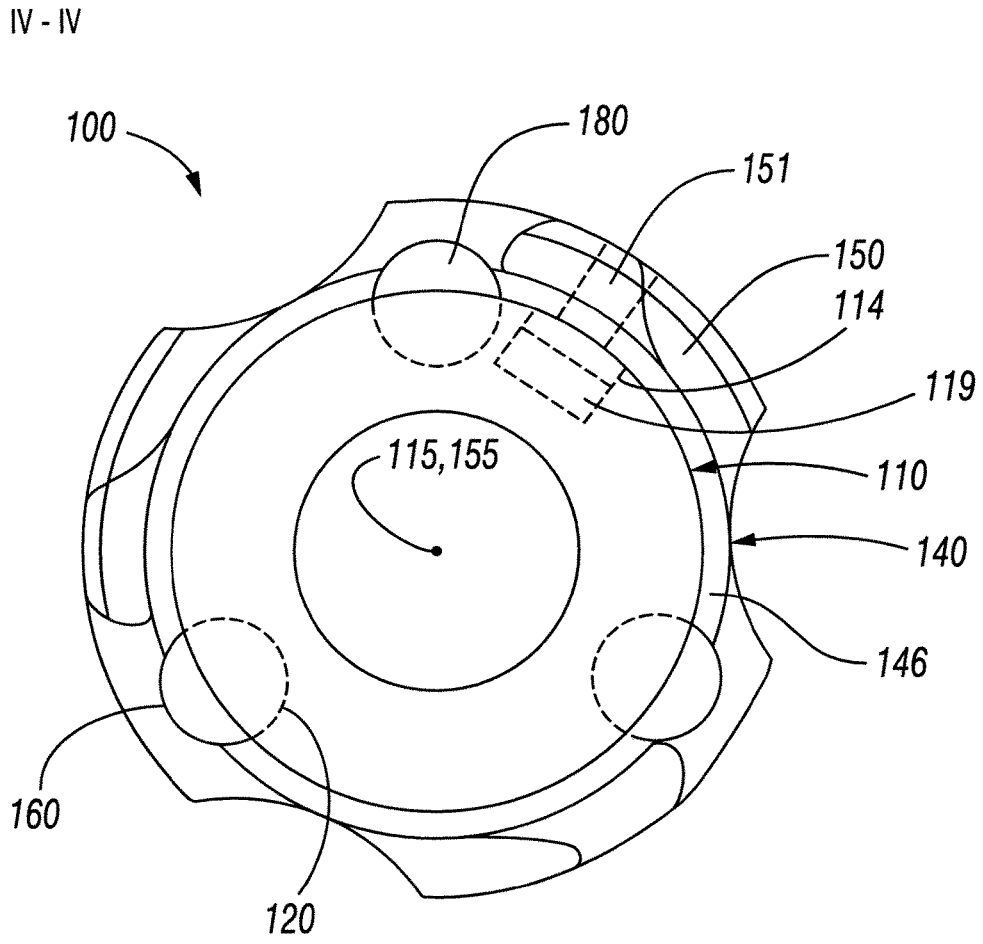
FIG. 4 is a top view of a portion of the apparatus shown in FIG. 3 according to one or more aspects of the present disclosure.

FIG. 2 is a perspective view of an example implementation of the stabilizer assembly 100 shown in FIG. 1 according to one or more aspects of the present disclosure. FIG. 3 is a sectional view of the stabilizer assembly 100 shown in FIG. 2 according to one or more aspects of the present disclosure. FIG. 4 is a top view of the stabilizer assembly 100 shown in FIG. 3 according to one or more aspects of the present disclosure. The following description refers to FIGS. 1-4, collectively.

The stabilizer assembly 100 comprises a drill collar 110, a sleeve 140, a plurality of round members 180, a biasing member 195, and a retaining member 190. The drill collar 110 may have a substantially tubular configuration having a wall 111 with an outer surface 113 and an inner surface 112 defining a longitudinal bore extending therethrough along a central axis 115 of the drill collar 110. The drill collar 110 may further comprise a plurality of cavities 120 having a concave configuration located on an outer surface 113 of the drill collar 110. Although the figures depict the drill collar 110 having three cavities, the drill collar 110 may comprise another number of cavities 120, as further described below. The drill collar 110 may be or comprise a section of drill pipe and/or other tubular member intended for use in downhole applications.

The drill collar 110 may further comprise a thick portion 116, an intermediate portion 117, and a narrow portion 118, wherein each respective portion 116,117, 118 may have a progressively smaller outer diameter. The drill collar 110 may also comprise first and second shoulders 126, 127 at the transitions between the thick, intermediate, and narrow portions 116, 117, 118. The first and second shoulders 126, 127 may protrude radially outward from the outer surface 113 of the wall 111, and may extend around a substantial portion of the circumference of the outer surface 113.

The drill collar 110 may house therein one or more downhole sensors and/or tools 119. For example, the downhole tools 119 may be disposed within one or more sensor cavities 114, which may extend into or partially through the wall 111 of the drill collar 110 on the outer surface 113 of the drill collar 110. The sensor cavities 114 may be openings that extend through the wall 111 between the inner and outer surfaces 112, 113 of the drill collar 110. However, the drill collar 110 or the part of the drill collar 110 that is not covered by the sleeve 140 may not include sensors. Also, sensors may also be included in the sleeve 140, such as the blade 150.

The sleeve 140 may have a substantially tubular configuration with a wall 141 having a wide portion defined by a first inner surface 142 and a narrow portion defined by a second inner surface 143, wherein the first and second inner surfaces 142, 143 define at least a portion of a longitudinal bore extending through the sleeve 140. The sleeve 140 may further comprise a shoulder 144, such as may be operable to transition between the first and second inner surfaces 142, 143. The shoulder 144 may protrude radially inward from the first inner surface 142 and extend circumferentially between the first and second inner surfaces 142, 143. The sleeve 140 may be slidably disposed about the drill collar 110, wherein the first inner surface 142 may be disposed about the thick portion 116 of the drill collar 110. The inner diameter of the first inner surface 142 of the sleeve 140 may be slightly larger than the outer diameter of the thick portion 116 of the drill collar 110. For example, the diameter of the first inner surface 142 may be less than about one millimeter larger that the outer diameter of the thick portion 116 of the drill collar 110.

The sleeve 140 may further comprise a plurality of blades 150 extending radially outward from the sleeve 140. The thickness of the wall 141 may be increased at locations where the blades 150 are present, such as by an amount ranging between about two centimeters and about five centimeters. Although three relatively short and wide blades 150 are depicted, the sleeve 140 may comprise another number of blades 150 in different configurations. Each blade may extend in a substantially helical manner, as shown in FIG. 2, or in another manner having a substantially longitudinal component permitting the passage of drilling fluid and debris within the wellbore.

The sleeve 140 may further comprise one or more windows 151 extending through one or more of the blades 150 and/or other portions of the wall 141. Each window 151 may extend through the portion of the wall 141 that comprises a blade 150 or other portions of the wall 141. Each window 151 may comprise an aperture extending radially though the wall 141. The aperture may be open to the wellbore or comprise therein a transparent or translucent material, a low-density material, or other material that may allow the passage of energy and/or signals emitted by the downhole tool 119. For example, each window 151 may comprise sapphire and/or other optically- or EM-transparent materials. Each window 151 may be aligned with the cavity 114 and/or the downhole tool 119 disposed within the cavity 114, for example, to allow passage of signals from the downhole tool 119 through the window 151 and into the sidewall of the wellbore 11.

Figure 5:
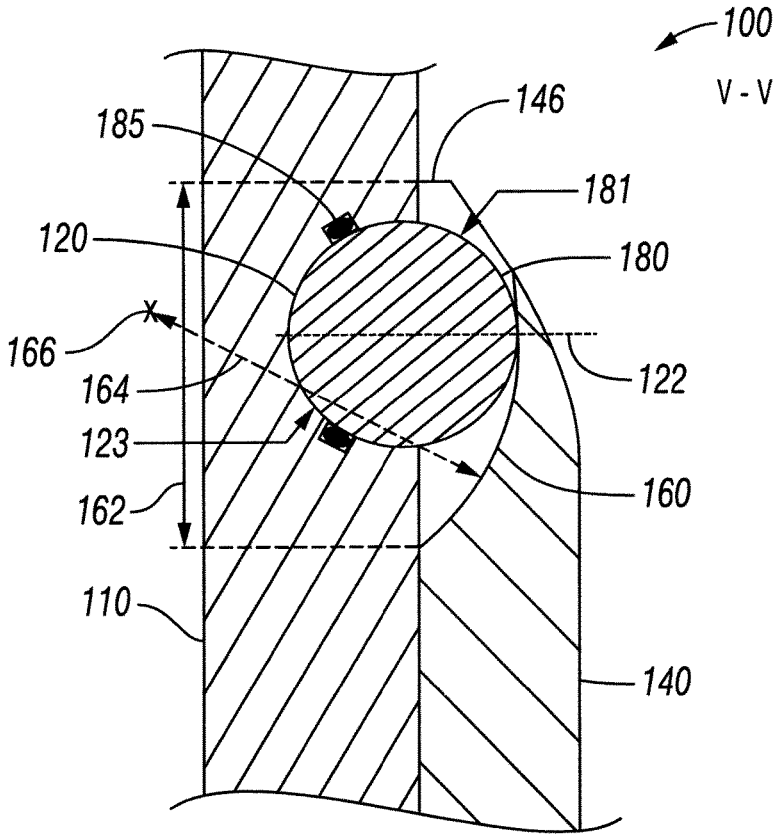
FIG. 5 is an enlarged view of a portion of the apparatus shown in FIG. 3 according to one or more aspects of the present disclosure.
Figure 6:
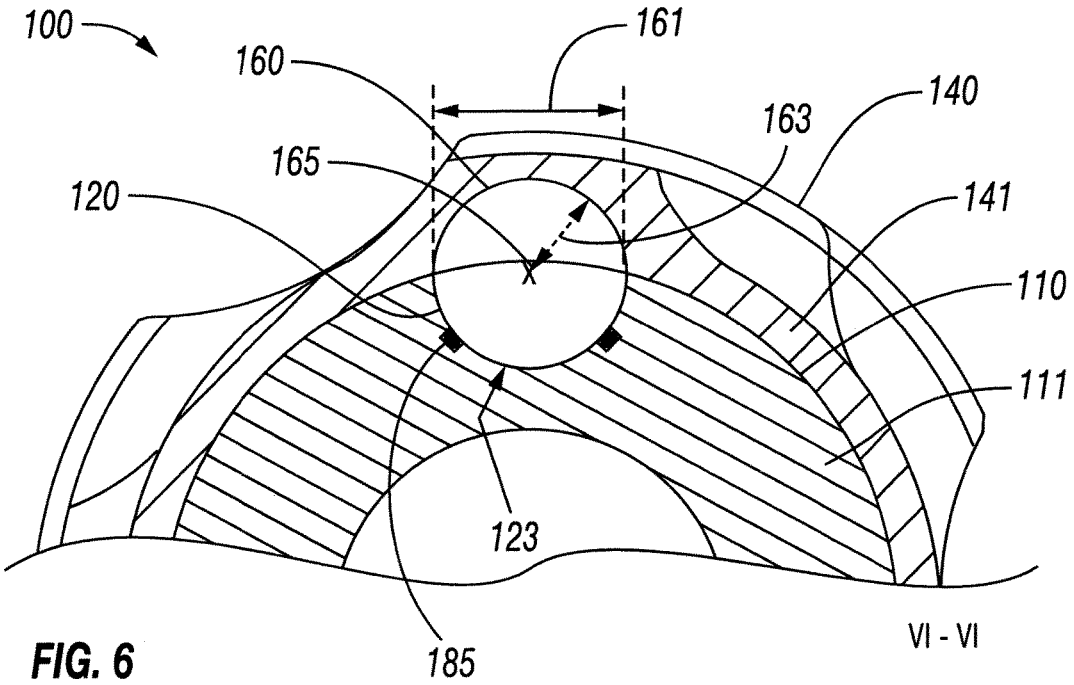
FIG. 6 is an enlarged sectional view of a portion of the apparatus shown in FIG. 3 according to one or more aspects of the present disclosure.

FIG. 5 is an enlarged view of a portion of the stabilizer assembly 100 shown in FIG. 3, and FIG. 6 is an enlarged end sectional view of a portion of the stabilizer assembly 100 shown in FIG. 3 but with the round member 180 removed. Referring now to FIGS. 3-6, collectively, the sleeve 140 may comprise a plurality of cavities 160 extending into the first inner surface 142 of the sleeve 140. The plurality of cavities 160 may be located at the uphole end of the sleeve 140, and may each intersect a terminal edge or rim 146 defining the uphole end of the sleeve 140. Therefore, the cavities 160 may be open at their uphole end. Such location of the plurality of cavities 160 may result in cavity openings facing both radially inward and axially uphole directions.

Each cavity 160 has a rounded profile or shape, such as a substantially spherical, cylindrical, or otherwise curved surface that may substantially lack sharp edges. Each cavity 160 may be elongated, having a width 161 and a length 162 measured at the first inner surface 142 of the sleeve 140, wherein the length 162 may be substantially greater than the width 161. Each cavity 160 may comprise a first radius 163 and a second radius 164, wherein the second radius 164 may be substantially greater than the first radius 163. The first radius 163 may be measured with respect to a first geometric center 165 of each cavity 160 along an axis extending substantially parallel to the central axis 155 of the sleeve 140. The second radius 164 may be measured with respect to a second geometric center 166 of each cavity 160 along an axis extending substantially perpendicular to the central axis 155. Although the second radius 164 is shown being greater than the first radius 163, they may be substantially equal to each other, substantially equal to a radius 181 of the round member 180, or substantially greater than the radius 181 of the round member 180.

The cavities 120 in the outer surface 113 of the drill collar 110 each correspond to and face one of the cavities 160 of the sleeve 140. Each cavity 120 may comprise an inwardly curved, concave, round, substantially spherical, or otherwise curved surface lacking sharp edges. For example, each cavity 120 may be hemispherical. Each cavity 120 may comprise a shape and/or radius 123 that closely matches the shape and/or radius of the round member 180, and is otherwise able to receive and aid in retaining the corresponding round member 180. Substantially spherical cavities, such as the cavities 120, may match the shape of a corresponding round member 180 more closely than elongated and/or cylindrical cavities, such as the cavities 160. Substantially spherical cavities may create a smooth transition between surfaces of the round members 180 and such substantially spherical cavities, such as may reduce stress concentrations at the points of contact. Elongated and/or cylindrical cavities may create an increasingly drastic transition between surfaces of the round members 180 and such elongated or cylindrical cavities, which may increase stress concentrations at the points of contact.

The plurality of cavities 160 of the sleeve 140, as described above, will hereinafter be referred to as sleeve cavities 160, and the plurality of cavities 120 of the drill collar 110, as described above, will hereinafter be referred to as drill collar cavities 120. However, as the drill collar 110 may also be some other tubular member, the drill collar cavities 120 may also be referred to herein as tubular cavities.

Each round member 180 may be a discrete member disposed in the cavities 120, 160 between the drill collar 110 and the sleeve 140, so as to contact the sleeve 140 and the drill collar 110. The round members 180 may serve as interlocking members between the drill collar 110 and the sleeve 140, wherein contact between the round members 180 and the corresponding portions of the drill collar cavities 120 and the sleeve cavities 160 may prevent and/or limit relative axial and rotational motion of the drill collar 110 and the sleeve 140. A portion of each round member 180 may be disposed within a corresponding drill collar cavity, 120 while another portion of each round member 180 may be disposed within a corresponding sleeve cavity 160. Each round member 180 may be or comprise a substantially spherical or other ball-like configuration. However, other implementations are also within the scope of the present disclosure. For example, each round member 180 may be a spheroid or other substantially round or rounded member. At least a portion of each round member 180 may be or comprise a substantially spherical, outwardly curved, convex, and/or otherwise rounded surface substantially lacking sharp edges. The round members 180 may be manufactured from or otherwise comprise a metal, ceramic, or other hard material. For example, the round members 180 may substantially comprise tungsten carbide or silicon nitride. Also, although the figures depict three round members 180, the stabilizer assembly 100 may comprise additional round members (e.g., see FIGS. 10 and 11) disposed in additional corresponding sleeve and drill collar cavities, as described below. Therefore, the term "round," as used herein, may be defined as curved, spherical, or at least partially spherical. Furthermore, the term "curved surface," as used herein, may be defined as a surface that is at least partially curved.

The stabilizer assembly 100 may further comprise sealing members 185 disposed between the drill collar 110 and the round members 180 within the drill collar cavities 120. The sealing members 185 may extend partially or substantially around a central axis 122 of each drill collar cavity 120 that extends radially outward from the central axis 115 of the drill collar 110. The sealing members 185 may be operable to maintain at least a portion of the contact area/space between the collar 110 and the round members 180, surrounded by each sealing member 185, as being substantially clean and/or contaminant free, such as by reducing or preventing foreign fluid, particles, and/or other contaminants from moving into the contact area/space. For example, the sealing members 185 may be operable to reduce or prevent wellbore fluid from leaking into the contact area/space between the drill collar 110 and the corresponding round members 180. Such contact area/space may contain therein air, oil, and/or grease, and the sealing members 185 may also be operable to reduce or prevent the air, oil, and/or grease from escaping out of the contact area/space during operations. The sealing members 185 may also maintain a pressure differential between the internal pressure of the contact area/space and the hydrostatic pressure of the wellbore fluid, while the substantially greater hydrostatic pressure of the wellbore fluid may force the round members 180 against the surface of the drill collar cavity 120 to maintain the round members 180 within the drill collar cavities 120. Each sealing member 185 may be or comprise an O-ring, a cup seal, and/or other fluid-sealing elements. As shown in FIGS. 5 and 6, each sealing member 185 may be disposed within a peripheral groove extending within the drill collar cavity 120, wherein the peripheral groove opens outwardly from the cavity 120, permitting the sealing member 185 to be disposed therein.

To aid in ensuring contact between the round members 180 and each of the drill collar 110 and the sleeve 140, the sleeve 140 may be biased against the round members 180 by a biasing member 195, which may be retained in position by a retaining member 190. The biasing member 195 and the retaining member 190 may also aid in maintaining adequate alignment of the window(s) 151 of the sleeve 149 with the corresponding sensor(s) and/or other tool(s) 119 of the drill collar 110.

The biasing member 195 may comprise one or more Belleville springs, compression springs, and/or other biasing means operable to create an axial biasing force against the sleeve 140. The biasing member 195 may continually push the sleeve 140 against the round member 180, such as may result in a continuous positive contact pressure between the round members 180 and each of the drill collar 110 and the sleeve 140.

The retaining member 190 may be or comprise a locking nut having internal threads 192, such as may be operable to threadedly engage external threads 129 of the drill collar 110. The retaining member 190 may be disposed at a predetermined position along the drill collar 110, such as may result in a predetermined compression of the biasing member 195 and, therefore, a predetermined biasing force exerted by the biasing member 195 against the sleeve 140. The predetermined biasing force, in turn, may result in a predetermined contact force between the sleeve 140, the round member 180, and the drill collar 110, The compression of the biasing member 195 may be increased by translating the retaining member 190 axially toward the sleeve 140 and decreased by translating the retaining member 190 axially away from the sleeve 140. Furthermore, to ensure that a predetermined compression of the biasing member 195 is attained, the retaining member 190 may be translated axially toward the sleeve 140 until the retaining member 190 contacts the second shoulder 127. As the second shoulder may prevent additional axial translation of the retaining member 190, a consistent compression of the biasing member 195 may be attained by torqueing the retaining member 190 until it bottoms out against the second shoulder 127. Therefore, the compression of the biasing member 195 may be controlled by the axial position of the second shoulder 127 along the drill collar 110. Such configuration may be operable to create the predetermined compression of the biasing member 195, perhaps independent of the amount of torque imparted to the retaining member 190. The biasing member 195 may generate a biasing force ranging between about ten kilo-pounds force (klbf) (or about 44.48 kilonewtons) and about fifty klbf (or about 222.40 kilonewtons), although other biasing forces are also within the scope of the present disclosure.

Figure 7:
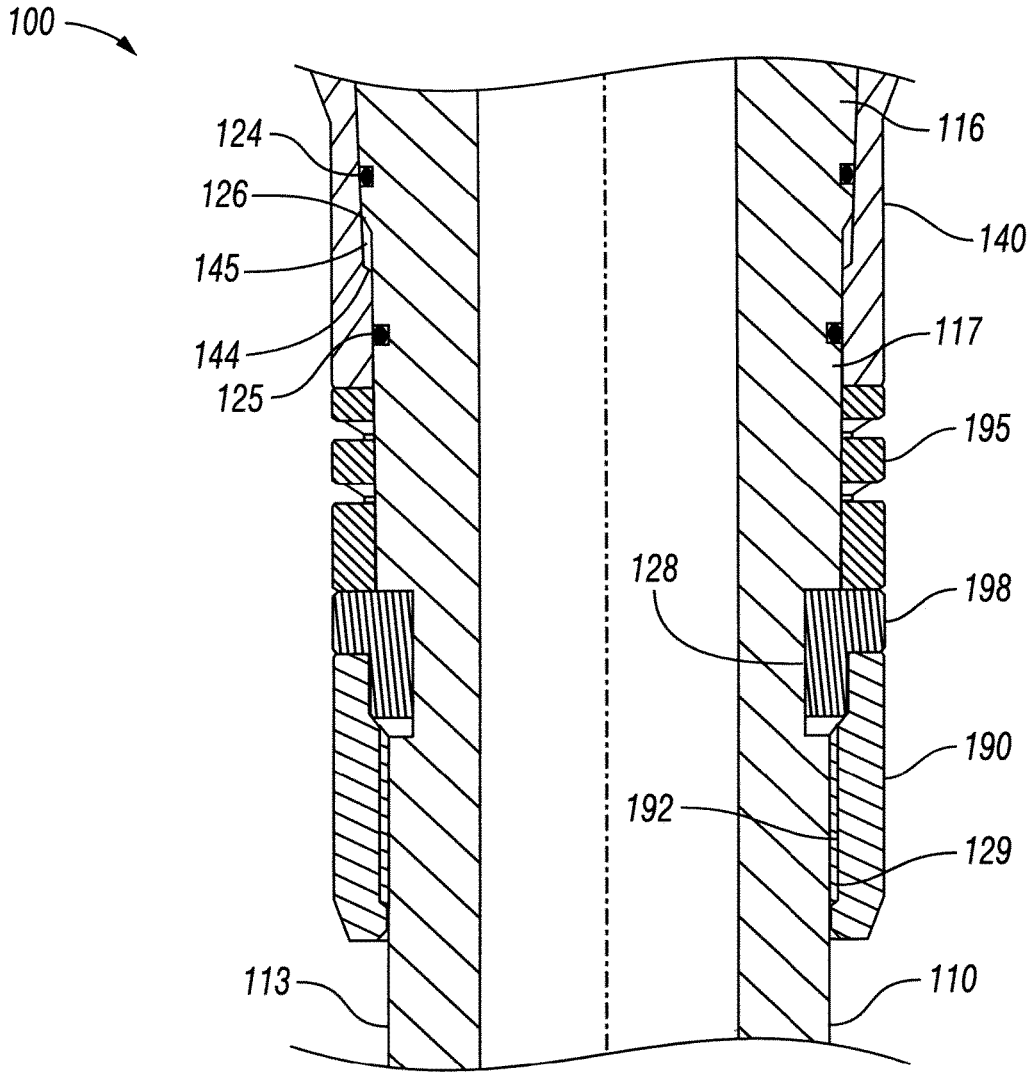
FIG. 7 is a side sectional view of an example implementation of a portion of the apparatus shown in FIG. 1 according to one or more aspects of the present disclosure.

FIG. 7 is an enlarged side sectional view of an example implementation of a portion of the stabilizer 100 shown in FIG. 1 according to one or more aspects of the present disclosure. Referring to FIGS. 3 and 7, collectively, the compression of the biasing member 195 may also be achieved by a retaining ring 198 disposed within a groove 128 located along the outside surface 113 the drill collar 110. Prior to being compressed (i.e., in its natural state), a portion of the biasing member 195 may extend about and/or cover at least a portion of the groove 128. The retaining ring 198 may be narrower than the groove 128 and may be or comprise a snap ring, a split ring, and/or other member operable to maintain position within the groove 128. During assembly, the retaining ring 198 may be disposed within the groove 128 between the biasing member 195 and the lower sidewall of the groove 128. The retaining member 190 may then be disposed about the drill collar 110 and engaged with the external threads 129 until the retaining member 190 contacts the retaining ring 198. Thereafter, the retaining member 190 may be further rotated to slide or otherwise move the retaining ring 198 against the biasing member 195 and along the groove 128. The retaining member 190 may be further rotated to compress the biasing member 195 until the retaining ring 198 contacts the upper sidewall of the groove 128 to, thereby, secure the retaining ring 198 in position and maintain the biasing member 195 compressed. Therefore, the magnitude of compression of the biasing member 195 may be controlled by the axial position of the groove 128 along the outer surface 113 of the drill collar 110.

The biasing force generated by the biasing member 195 may sufficient to ensure continuous positive contact between the round members 180 and each of the drill collar 110 and the sleeve 140 during drilling and other operations. For example, the biasing force may aid in maintaining contact between the round members 180 and each of the drill collar 110 and the sleeve 140 when contact surfaces between these components physically change due to wear and/or deformation.

A force generated by the hydrostatic wellbore pressure in the ambient space surrounding the stabilizer assembly 100 may further bias the sleeve 140 axially against the round members 180. For example, the stabilizer assembly 100 may further comprise an annular cavity 145 formed between the drill collar 110 and the sleeve 140, in the radial direction, and between the first shoulder 126 and the sleeve shoulder 144, in the axial direction. As the stabilizer assembly 100 descends within the wellbore, a pressure differential may be formed between the hydrostatic pressure of the wellbore fluid and the pressure within the annular cavity 145, which may be lower than the hydrostatic pressure and/or substantially equal to the atmospheric pressure at the wellbore surface. The pressure differential causes a net force differential, wherein the uphole force due to the hydrostatic pressure is greater than the downhole force due to the pressure within the annular cavity 145, resulting in a net force in the uphole direction being imparted to the sleeve 140.

To facilitate the annular cavity 145 to maintain a predetermined pressure, such as a pressure that is lower than the hydrostatic pressure and/or substantially equal to the atmospheric pressure at the wellbore surface, the stabilizer assembly 100 may further comprise sealing members 124, 125 disposed proximate axially opposing ends of the annular cavity 145. The drill collar 110, the sleeve 140, or both may carry the sealing members 124, 125. The sealing member 124 may be disposed about the thick portion 116 of the drill collar 110, and the sealing member 125 may be disposed about the intermediate portion 117 of the drill collar 110. The sealing members 124, 125 may be operable for sealingly engaging the drill collar 110 and the sleeve 140, such as may reduce or prevent wellbore fluid from leaking into the annular cavity 145 and/or prevent gas within the annular cavity 145 from escaping therefrom. The sealing members 124, 125 may each be or comprise an O-ring, a cup seal, and/or other fluid-sealing elements. The biasing force generated by the biasing member 195 and the force generated by the hydrostatic pressure in the wellbore, along with other forces biasing the sleeve 140 against the round members 180, may be collectively referred to hereinafter as the axial force 101.

Figure 8:
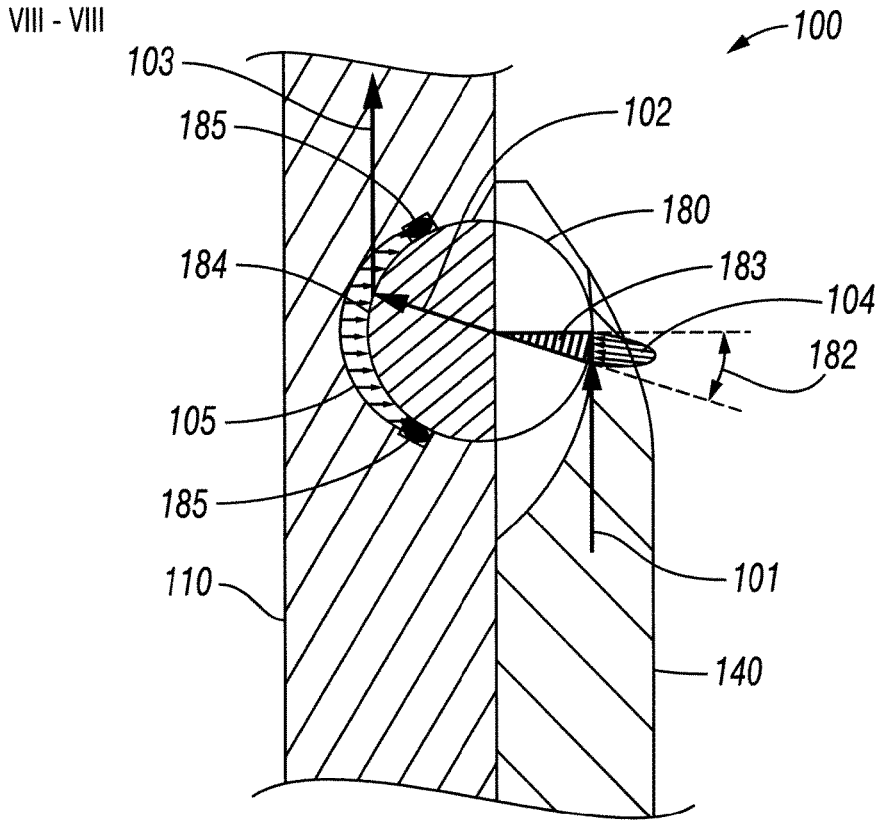
FIG. 8 is an enlarged view of a portion of the apparatus shown in FIG. 3 according to one or more aspects of the present disclosure.

FIG. 8 is substantially similar to FIG. 5 but with additional notations to facilitate the following description. Referring collectively to FIGS. 3 and 8, the plurality of round members 180 may prevent or limit relative axial and rotational movement between the drill collar 110 and the sleeve 140. In FIG. 8, the axial force 101 is shown being transferred from the sleeve 140, through the round member 180, to the drill collar 110. For example, as a result of the contact angle 182 and location of the contact area 183 between the sleeve 140 and the round member 180, the axial force 101 may be transferred through the round member 180, as indicated by arrow 102, to the drill collar 110, as indicated by arrow 103, whereby a reaction force between the sleeve 110 and the round member 180 pushes the round member 180 against the drill collar cavity 120 and the sealing member 185. As the round members 180 are pushed against the drill collar cavities 120, contact pressures 104, 105 may be created between these components. The contact angle 182 and the contact area 183 may be adjusted to meet operational specifications of the stabilizer assembly 100 by varying the size and shape of the round members 180 and/or the sleeve cavities 160.

Figure 9:
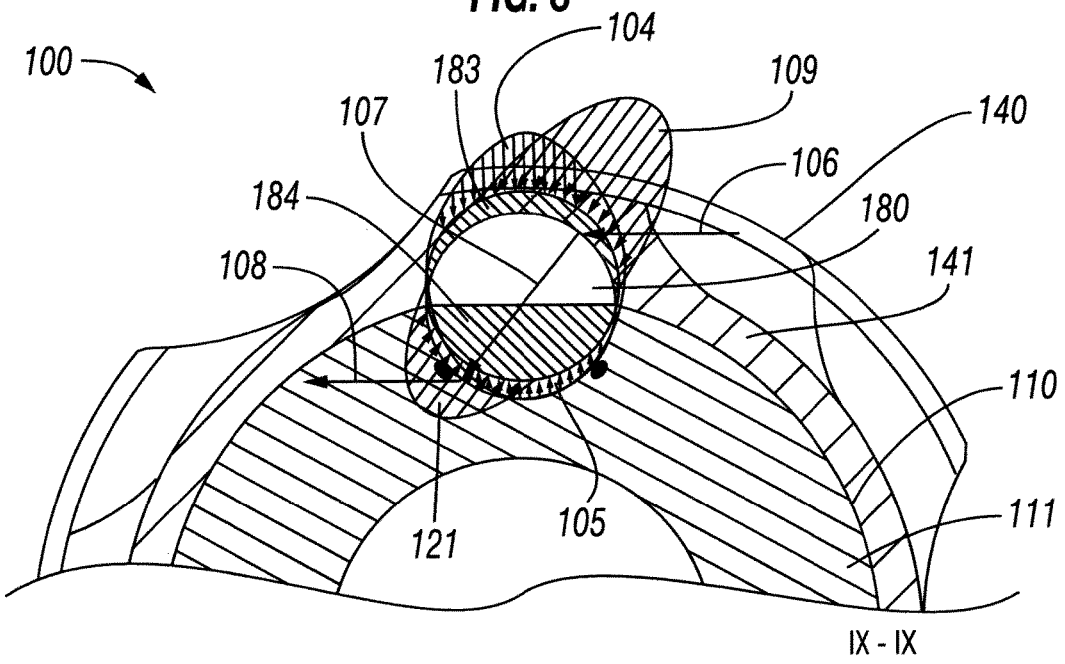
FIG. 9 is an enlarged sectional view of a portion of the apparatus shown in FIG. 3 according to one or more aspects of the present disclosure.

In this same context, FIG. 9 is substantially similar to FIG. 6 but with additional notations to facilitate the following description. The contact pressures 104, 105 generated by the axial force 101, as explained above, is further shown from a top perspective in FIG. 9. For example, from the top perspective, the contact pressures 104, 105 are shown substantially distributed around the ball member 180, as opposed to the side perspective of FIG. 8. However, because the contact area 183 is substantially smaller than the contact area 184, the magnitude of the contact pressure 104 is substantially greater than the magnitude of the contact pressure 105, which may result in greater wear and/or deformation of the sleeve 140 and/or the round member 180 at the contact area 183. Also, the resistance of the sleeve 140 to rotate within the wellbore, such as due to friction against the side of the wellbore, may produce a reaction force 106, which may be transferred from the sleeve 140 through the round member 180, as indicated by arrow 107, to the drill collar 110, as indicated by arrow 108. As the round member 180 is pushed by the sleeve 140 against the drill collar cavity 120, contact pressures 109, 121 may be created between these components. As shown in the top perspective of FIG. 9, the contact pressures 109, 121 are shown substantially distributed around the ball member 180, however, because the contact area 183 is substantially smaller than the contact area 184, the magnitude of the contact pressure 109 is substantially greater than the magnitude of the contact pressure 121, which may result in greater wear and/or deformation of the sleeve 140 and/or the round member 180 at the contact area 183.

To minimize the effect of surface deformation of the drill collar cavities 120 and the sleeve cavities 160 due to erratic torque force 106, for example, the round members 180 may be maintained in continuous contact along predetermined contact areas 183, 184 of the sleeve cavities 160 and the drill collar cavities 120 during operations, such as when the stabilizing assembly 100 is subjected to high bending stresses during sharp turns of the BHA 35. To maintain such continuous contact, the axial force 101 may be predetermined so as to aid in preventing or minimizing unloading of portions of the predetermined contact areas 183, 184 opposite to the applied torque force 106. Continuous compression along the predetermined contact areas 183, 184 may result in an increased and/or uniform distribution of the axial forces 101, the torque forces 106, and/or other forces generated during operations.

The close fit between the radius 181 of each round member 180 and the radius 123 of each drill collar cavity 120 may permit contact between each round member 180 and the corresponding drill collar cavity 120 along the contact area 184, which may comprise a substantial portion of the drill collar cavity 120 or even the entirety of the drill collar cavity 120. Such large distribution of the resulting axial and torque forces 101, 106 may result in smaller pressures 105, 121 between the round members 180 and the drill collar cavities 120, which may decrease the rate of wear and deformation of the drill collar 110 and the portions of the round members 180 in contact therewith. The close fit between the radius 181 of each round member 180 and the first radius 163 of the corresponding sleeve cavity 120, and the lack of a close fit between the radius 181 of each round member 180 and the second radius 164 of the corresponding sleeve cavity 120, may result in contact between each sleeve cavity 120 and the corresponding round member 180 along the contact area 183, which may have a spherical lune, wedge, and/or other shape, and which is substantially smaller than the contact area 184. Such lesser distribution of the axial and torque forces 101, 106 may result in larger pressures 104, 109 between the round members 180 and the sleeve cavities 160, which may result in a higher rate of wear and deformation of the sleeve 140 and the portions of the round members 180 in contact therewith.

To increase the contact area 183 and, therefore, decrease the contact pressures 104, 109, the sleeve cavity 160 may be reconfigured. For example, the second radius 164 may be partially reduced, or reduced to substantially match the radius 181 of the round member 180, resulting in a substantially close fit between the round member 180 and the collar cavity 160.

Although the stabilizer assembly 100 described above includes drill collar cavities 120 each having a radius 123 that closely matches the radius 181 of the round members 180, and sleeve cavities 160 each having a first radius 123 that closely matches the radius 181 and a second radius 164 that is larger than the radius 181, the stabilizer assembly 100 may comprise a reversed configuration wherein the sleeve cavities 160 have a radius that closely matches the radius 181 of the round member 180 and the drill collar cavities 120 have a first radius that closely matches the radius 181 and a second radius that is larger than the radius 181. Therefore, the drill collar cavities 120 may comprise the configuration of the sleeve cavities 160 as described above, and the sleeve cavities 160 may comprise the configuration of the drill collar cavities 120 as described above.

Figure 10:
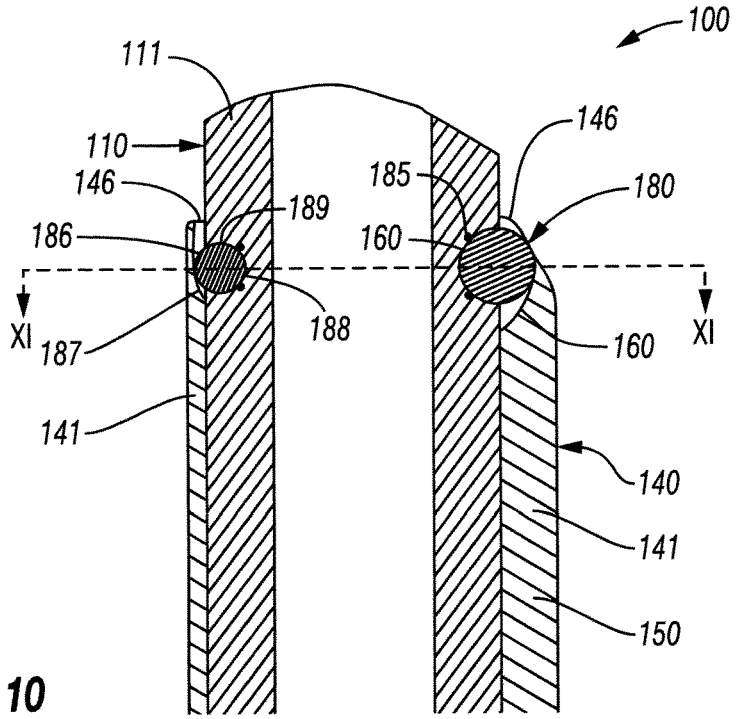
FIG. 10 is a side sectional view of an example implementation of a portion of the apparatus shown in FIG. 1 according to one or more aspects of the present disclosure.
Figure 11:
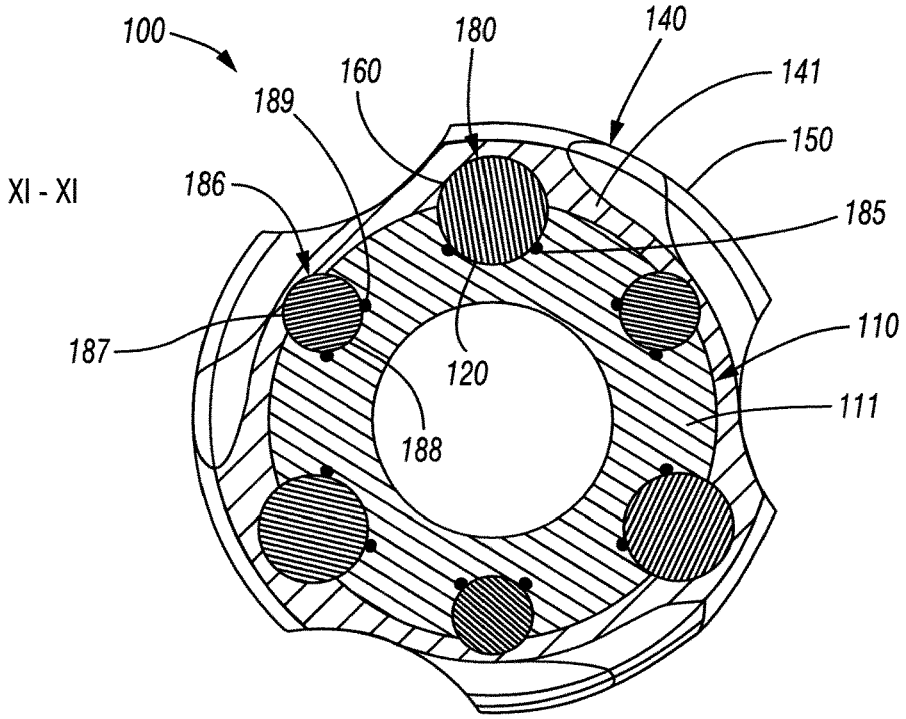
FIG. 11 is a top sectional of the apparatus shown in FIG. 10 according to one or more aspects of the present disclosure.

FIG. 10 is a side sectional view of a portion of another example implementation of the stabilizer assembly 100 shown in FIG. 1 according to one or more aspects of the present disclosure. FIG. 11 is a sectional view of the stabilizer assembly 100 shown in FIG. 10. Depending on the forces that the stabilizer 100 may encounter, additional sleeve cavities 187 and drill collar cavities 188 may be utilized, with additional round members 186 disposed therein.

The additional round members 186, sleeve cavities 187, and drill collar cavities 188 may further distribute the axial force 101, the torque force 106, and/or other forces and, therefore, may reduce the rate of wear and deformation caused by contact between these components. The additional round members 186, sleeve cavities 187, and drill collar cavities 188 may be disposed circumferentially between the round members 180, sleeve cavities 160, and drill collar cavities 120, but may otherwise comprise the same or similar configuration and/or operation as the round members 180, sleeve cavities 160, and drill collar cavities 120 described above. The additional round members 186, sleeve cavities 187, and drill collar cavities 188 may be smaller if, for example, the wall 141 of the sleeve 140 adjacent the sleeve terminal edge 146 is thinner than the portions of the wall 141 comprising the round members 180, sleeve cavities 160, and drill collar cavities 120. Although the round members 180 are shown evenly and/or symmetrically distributed around the periphery of the drill sleeve 110, the round members 180 may be positioned about the drill collar 110 in non-symmetrical or other arrangements.

The stabilizer assembly 100 may further comprise additional sealing members 189 disposed between the drill collar 110 and the additional round members 186 within the additional drill collar cavities 188. The sealing members 189 may be operable to maintain at least a portion of the contact area/space between the collar 110 and additional round members 186, surrounded by each sealing member 189, as being substantially clean and/or contaminant free by reducing or preventing the entry of foreign fluid, particles, and/or other contaminants. Such contact area/space may contain therein air, oil, and/or grease, wherein the sealing members 189 may also be operable to reduce or prevent the air, oil, and/or grease from escaping out of the contact area/space during operations. The sealing members 189 may also maintain a pressure differential between the internal pressure of the contact area/space and the hydrostatic pressure of the wellbore fluid, and the substantially greater hydrostatic pressure of the wellbore fluid may force the additional round members 186 against the surface of their corresponding drill collar cavities 188 to maintain the additional round members 186 within their corresponding drill collar cavities 188. The additional sealing members 189 may be sized to accommodate the additional round members 189, and may otherwise comprise the same or similar configuration and/or operation as the sealing members 185 described above.

To further minimize wear and deformation of the drill collar cavities 120 and the sleeve cavities 160, the surfaces of the cavities 120, 160 may be coated with a coating material (not shown) that is substantially harder and/or more resistant to abrasion than the material forming the drill collar 110 and the sleeve 140. The coating material may also be utilized for filling and/or repairing wear and deformation in the drill collar cavities 120 and the sleeve cavities 160. The coating material may be sprayed, welded, clad, or otherwise applied to the surface of the cavities 120, 160. The surfaces of the cavities 120, 160 may also or instead be heat-treated to harden the surfaces and/or otherwise make them more resistant to wear and deformation.

Figure 12:
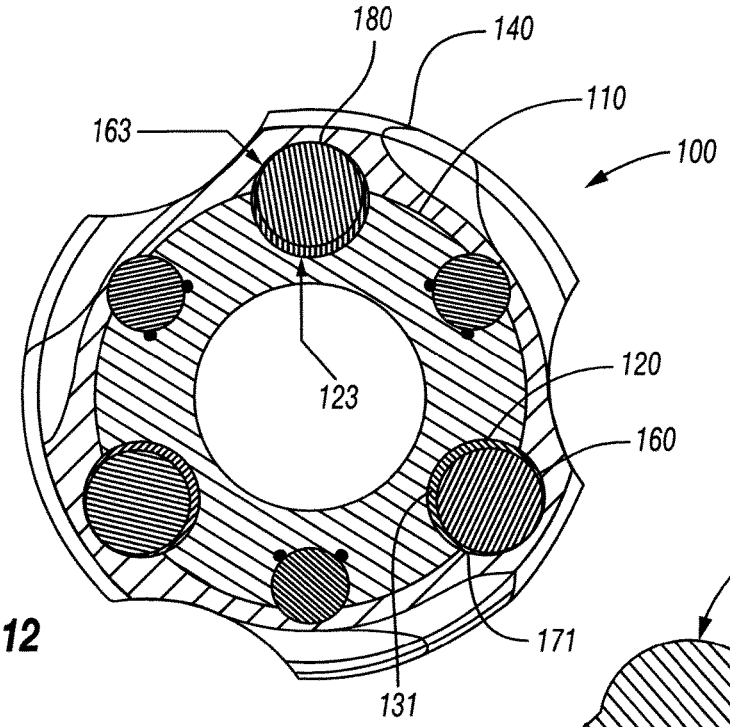
FIG. 12 is a top sectional view of a portion of an example implementation of the apparatus shown in FIG. 1 according to one or more aspects of the present disclosure.

FIG. 12 is a sectional view of another example implementation of a portion of the stabilizer assembly 100 shown in FIG. 1 according to one or more aspects of the present disclosure. To repair wear, abrasion, and/or other deformities on the surfaces of the drill collar cavities 120 and the sleeve cavities 160, the cavities 120, 160 may, for example, be turned down or otherwise resurfaced. Such resurfacing may increase the radii 123, 163 of the cavities 120, 160, such that larger round members (not shown) may be inserted therein. FIG. 12 depicts the stabilizer assembly 100 comprising an example of turned down or resurfaced cavities 120, 160, wherein portions 131, 171 thereof have been removed. The original round members 180 are shown in their original position to help identify the portions 131, 171 of cavities 120, 160 that were removed.

Figure 13:
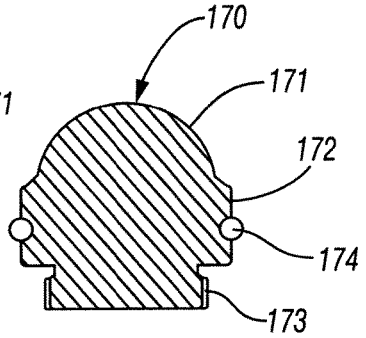
FIG. 13 is a top sectional view of a portion of an example implementation of the apparatus shown in FIG. 1 according to one or more aspects of the present disclosure.

FIG. 13 is a sectional view of another example implementation of a portion of the stabilizer assembly 100 shown in FIG. 1 according to one or more aspects of the present disclosure. To minimize wear to the drill collar cavities 120, the round members 180 may be disposed within cups 135, which may be secured within cavities 130 extending into the outer surface 113 of the drill collar 110.

The radially inner portion of the cups 135 may be retained within the corresponding cavities 130 by interference fit, adhesive, threads, and/or other means. The cups 135 may also be retained within the corresponding cavities 130 by forming a pressure differential between the internal space between the cups 135 and the cavities 130 and the space external to the cups 135 and/or the round members 180, namely the wellbore surrounding the stabilizer assembly 100. For example, the hydrostatic pressure of the fluid in the wellbore may be higher than the atmospheric pressure of the air, oil, grease, or other intended material trapped between the cups 135 and the cavities 130 by one or more sealing members 132, thereby forcing the cups 135 into the cavities 130.

The radially outward portion of each cup 135 may comprise a cavity 134 to receive the round member 180 therein. The cavity 134 may comprise the same or similar configuration and/or function as that of the drill collar cavity 120 described above. When the cavity 134 has a predetermined level of wear or deformation, the cup 135 may be replaced, thus, replacing the cavity 134. The cups 135 may comprise material that that may be substantially the same or similar as the material forming the round members 180, which may be substantially harder and/or more resistant to abrasion than the material forming the drill collar 110 and/or the sleeve 140. The material forming the cups 135 may comprise metal, ceramic, and/or other materials. For example, the cups 135 may comprise tungsten carbide or silicon nitride.

Figure 14:
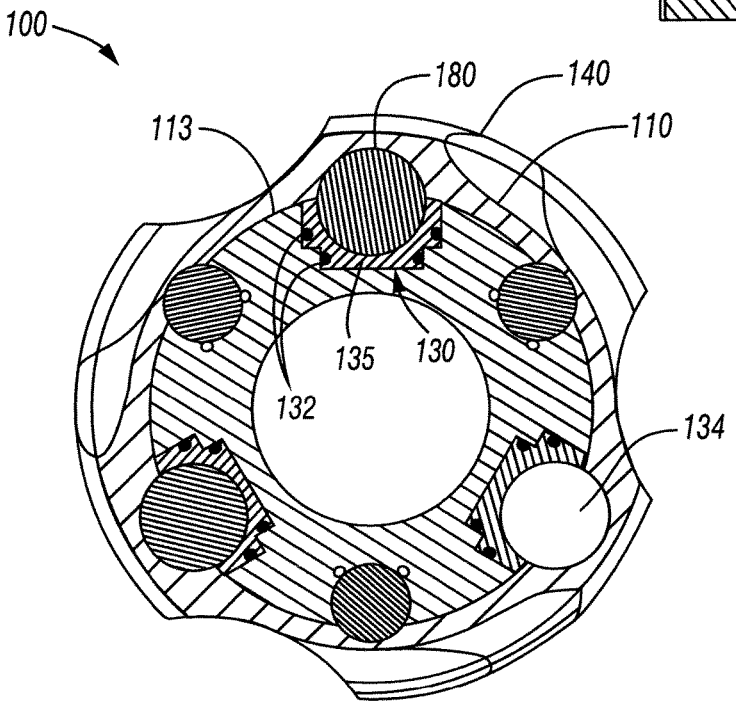
FIG. 14 is a side sectional view of a portion of an example implementation of the apparatus shown in FIG. 1 according to one or more aspects of the present disclosure.

FIG. 14 is a sectional view of a portion of another example implementation of the stabilizer assembly 100 shown in FIG. 1 according to one or more aspects of the present disclosure. The stabilizer assembly 100 may comprise a plurality of round members 170 that include a round external surface 171 and a base 172, similar to the cup 135 and round member 180 shown in FIG. 13, but formed integrally as a single piece configuration. The round surface 171 may comprise the same or similar configuration and/or function as the surface of the round members 180 as described above. The base 172 may permit the round members 170 to be retained within a corresponding one of a plurality of drill collar cavities, which may be similar to cavities 130 shown in FIG. 12. For example, the base 172 may comprise threads 173 and/or other fastening means operable for engagement within of the drill collar cavities 135.

The base 172 may further include one or more of the same or similar features of the cups 135 shown in FIG. 13. For example, the base 172 may comprise a sealing member 174, such as may prevent wellbore fluid or other fluid from leaking into the space between the drill collar (not shown) and the base 172. The round members 170 may comprise material that that is substantially the same or similar as the material forming the round members 180, as described above.

Figure 15:
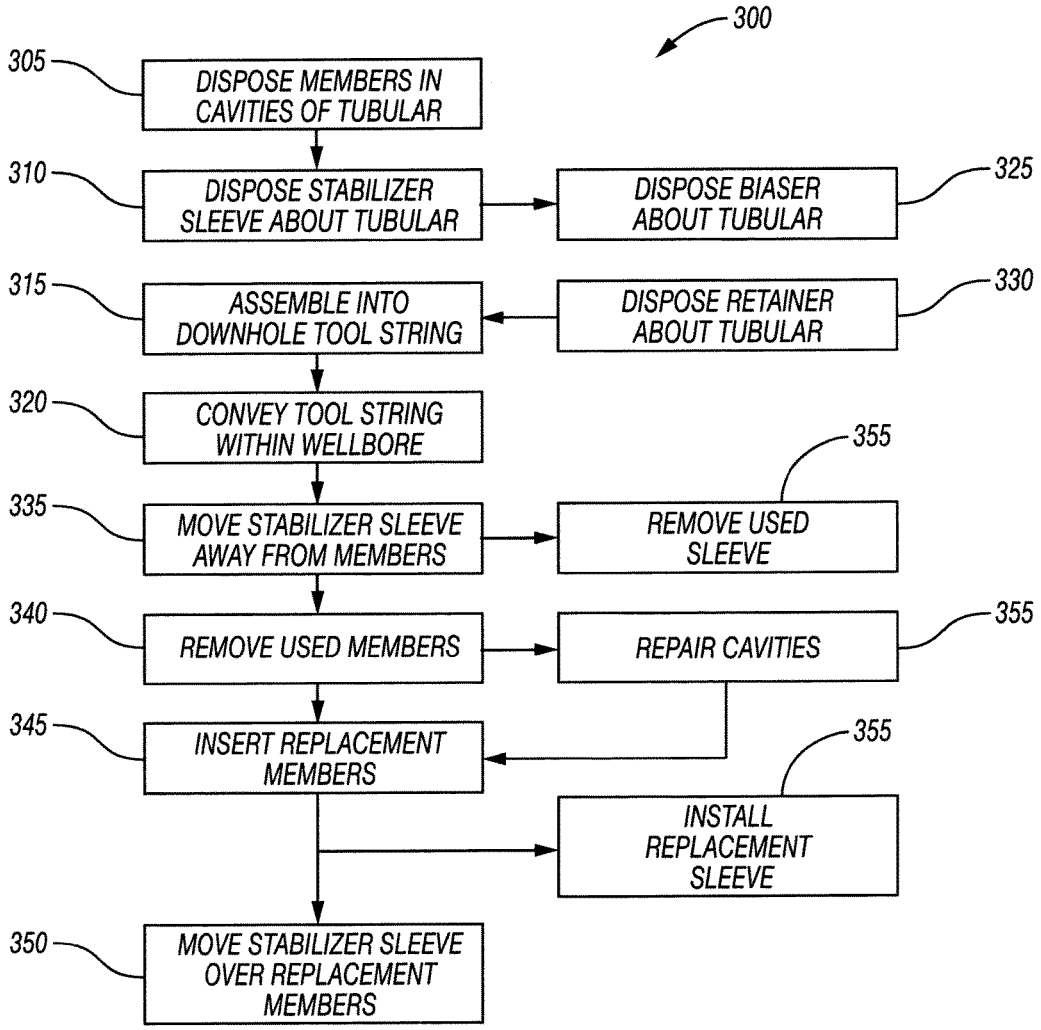
FIG. 15 is a flow-chart diagram of at least a portion of a method according to one or more aspects of the present disclosure.

FIG. 15 is a flow-chart diagram of at least a portion of an example implementation of a method (300) according to one or more aspects of the present disclosure. The method (300) may utilize at least a portion of a drilling system, such as the drilling system 10 shown in FIG. 1, and the stabilizer assembly 100 shown in one or more of FIGS. 1-14. Thus, the following description refers to FIGS. 1-15, collectively.

The method (300) comprises disposing (305) each of a plurality of members 180 within a corresponding one of a plurality of drill collar cavities 120 that each extend into an exterior surface 113 of a drill collar or other tubular 110. The method (300) also comprises disposing (310) a stabilizer sleeve 140 about the tubular 110 such that each of the plurality of members 180 is further positioned within a corresponding one of a plurality of sleeve cavities 160 that each extend into an interior surface of the sleeve 140. The tubular 110 may then be coupled (315) between opposing first and second portions of a BHA or other downhole tool string 35, which may then be conveyed (320) within a wellbore 11 extending into a subterranean formation 5.

Before assembling (315) the tubular 110 into the tool string 35, a biaser 195 may be disposed (325) about the tubular 110, wherein the biaser is operable to maintain each of the plurality of members 180 in contact with a corresponding one of each of the drill collar and sleeve cavities 120, 160. In such implementations, the method (300) may also comprise disposing (330) a retainer 190 about the tubular 110, such that the biaser 195 extends between the retainer 190 and an end of the stabilizer sleeve 140.

Implementations of the method (300) may include replacing portions of the stabilizer assembly 100 after such portions have become worn or otherwise deformed. In such implementations, the method (300) may further comprise moving (335) the sleeve 140 along the tubular 110 to move the plurality of sleeve cavities 160 away from the used members 180. The used members 180 may then be removed (340) from within the drill collar cavities 120. Replacement members 180 may then be inserted (345) into the drill collar cavities 120, and the sleeve 140 may be moved (350) along the tubular 110 such that each replacement member 180 is positioned within the corresponding drill collar and sleeve cavities 120, 160. At least one of the replacement members 180 may be substantially larger than each of the used members 180. Such implementations of the method (300) may also comprise repairing (355) at least one of the drill collar cavities 120 and/or at least one of the sleeve cavities 160. Such repair (355) may comprise machining to remove an irregularity from one or more of the cavities 120, 160 and/or adding material to one or more of the cavities 120, 160. The method (300) may also comprise removing (360) the sleeve 140 from the tubular 110 and installing (365) a replacement sleeve 140.

In view of the entirety of the present disclosure, including the figures and the claims, a person having ordinary skill in the art will readily recognize that the present disclosure introduces an apparatus comprising: a stabilizer assembly coupled between opposing first and second portions of a downhole drill string, wherein the stabilizer assembly comprises: a tubular member; a stabilizer sleeve slidably disposed about the tubular member and comprising at least one round cavity located in an inner surface of the stabilizer sleeve; and at least one round member disposed between the stabilizer sleeve and the tubular member, within the at least one round cavity, so as to contact both of the stabilizer sleeve and the tubular member.

The tubular member may be a drill collar or a drill pipe.

The stabilizer sleeve may comprise at least one external blade.

At least a portion of the at least one round member may comprise a curved surface contacting at least one of the stabilizer sleeve and the at least one round cavity.

The at least one round member may be substantially spherical.

The at least one round member may be operable to prevent relative rotation between the tubular member and the stabilizer sleeve.

The at least one round cavity may comprise at least three round cavities, and the at least one round member may comprise at least three round members each disposed within a corresponding one of the at least three round cavities.

The at least one round member may comprise a spherical, ball-like, oval, spheroidal, convex, rounded, curved, and/or other configuration substantially lacking sharp edges.

The at least one round cavity may comprise a concave surface.

The at least one round cavity may comprise at least one first round cavity, the tubular member may comprise at least one second round cavity located on an outer surface of the tubular member, and the at least one round member may be disposed the at least one first round cavity and the at least one second round cavity. The at least one first round cavity may have a first radius of curvature that is greater than a second radius of curvature of the at least one second round cavity. The at least one second round cavity may comprise a substantially curved surface. The stabilizer assembly may further comprise at least one sealing member disposed within the at least one second round cavity and contacting the at least one round member. The tubular member may comprise a first material, and the at least one second round cavity may be covered with a second material that is substantially harder and/or substantially more resistant to abrasion than the first material. The at least one second round cavity may comprise a heat-treated surface.

The stabilizer assembly may further comprise a biasing member disposed about the tubular member and axially urging the stabilizer sleeve into contact with the at least one round member. The stabilizer assembly may further comprise a retaining member fixedly connected with the tubular member to retain the biasing member between the retaining member and the stabilizer sleeve.

The stabilizer sleeve may comprise a first shoulder protruding radially inward from the inner surface of the sleeve, the tubular member may comprise a second shoulder protruding radially outward from an external surface of the tubular member, the first and second shoulders may form an annular space between the stabilizer sleeve and the tubular member, and the annular space may be fluidly isolated from a space external to the stabilizer assembly.

The stabilizer assembly may further comprise a sensor disposed within a sensor cavity located in an outer surface of the tubular member, the stabilizer sleeve may further comprise a window extending radially through the stabilizer sleeve, and the sensor cavity and the window may be substantially aligned with respect to each other. The stabilizer sleeve may comprise at least one external blade, and the window may be disposed within the at least one external blade.

The tubular member may comprise at least one opening in an outer surface of the tubular member, and the stabilizer assembly may further comprise at least one additional member disposed within the at least one opening. The at least one round cavity may be at least one first round cavity, the at least one additional member may be a cup comprising a second round cavity, and the at least one round member may be at least partially received within the second round cavity. The at least one additional member may comprise: a first portion comprising the at least one round member, and a second portion not comprising the at least one round member. The at least one additional member may be threadedly connected with the tubular member.

The at least one round member may be fixedly connected with the tubular member.

The present disclosure also introduces an apparatus comprising: a module for coupling between opposing first and second portions of a downhole string, wherein the module comprises: a tubular member operable for coupling between the opposing first and second portions of the downhole string, wherein the tubular member comprises a plurality of first cavities extending into an exterior surface of the tubular member; a sleeve disposed about the tubular member and comprising a plurality of second cavities extending into an internal surface of the sleeve; and a plurality of discrete members each comprising: a first portion disposed within a corresponding one of the plurality of first cavities; and a second portion disposed within a corresponding one of the plurality of second cavities; wherein at least one of the first and second portions is substantially spherical.

The tubular member may be a drill collar or a drill pipe.

The module may further comprise a plurality of sealing members each disposed between the tubular member and a corresponding one of the plurality of discrete members.

The module may further comprise: a biasing member disposed about the tubular member and operable to bias the sleeve axially into contact with each of the plurality of discrete members; and a retaining member fixedly connected with the tubular member to retain the biasing member between the retaining member and the sleeve.

The module may further comprise a sensor carried by the tubular member, the sleeve may further comprise an opening extending radially through the stabilizer sleeve, and the sensor cavity and the opening may be substantially aligned with respect to each other.

The present disclosure also introduces a method comprising: disposing each of a plurality of round members within a corresponding one of a plurality of tubular cavities that each extend into an exterior surface of a tubular member; and disposing a sleeve about the tubular member such that each of the plurality of round members is further positioned within a corresponding one of a plurality of sleeve cavities that each extend into an interior surface of the sleeve so as to contact the tubular member and the sleeve.

The method may further comprise disposing a cup in an opening that extends into the exterior surface of the tubular member. The cup may comprise one of the plurality of tubular cavities.

The method may further comprise coupling the tubular member between opposing first and second portions of a downhole tool string. The method may further comprise conveying the downhole tool string within a wellbore extending into a subterranean formation.

The method may further comprise disposing a biaser about the tubular member, wherein the biaser may be operable to maintain each of the plurality of round members in contact with a corresponding one of the plurality of tubular cavities and a corresponding one of the plurality of sleeve cavities. The method may further comprise disposing a retainer about the tubular member, wherein the biaser may extend between the retainer and an end of the sleeve.

Before performing the method, a plurality of used round members may already be positioned on the tubular member, and disposing each of the plurality of round members within a corresponding one of the plurality of tubular cavities may be performed after removing the plurality of used round members from within the plurality of tubular cavities. The method may further comprise repairing at least one of the plurality of tubular or sleeve cavities. Repairing the at least one of the plurality of tubular or sleeve cavities may comprise: machining to remove an irregularity from the at least one of the plurality of tubular or sleeve cavities; and/or replacing a portion of the tubular member or the sleeve comprising the at least one of the plurality of tubular or sleeve cavities. Repairing the at least one of the plurality of tubular or sleeve cavities may comprise adding material to the at least one of the plurality of tubular or sleeve cavities. At least one of the plurality of round members may be substantially larger than each of the plurality of used round members. The sleeve may be a replacement sleeve, the plurality of used round members may be positioned in a used sleeve, and the method may further comprise: before removing the plurality of used round members, removing the used sleeve from the tubular member.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus, comprising:

a stabilizer assembly coupled between opposing first and second portions of a downhole drill string, wherein the stabilizer assembly comprises:

a tubular member;

a stabilizer sleeve slidably disposed about the tubular member and comprising at least one first round cavity located in an inner surface of the stabilizer sleeve; and at least one round member disposed between the stabilizer sleeve and the tubular member, within the at least one round cavity, so as to contact both of the stabilizer sleeve and the tubular member, wherein the tubular member comprises at least one second round cavity located on an outer surface of the tubular member; and the at least one round member is at least partially disposed with the at least one first round cavity and the at least one second round cavity, wherein the at least one second round cavity has a second radius of curvature that closely fits a radius of curvature of the round member and wherein the at least one first round cavity has a first radius of curvature that is greater than the second radius of curvature and does not closely fit the radius of curvature of the round member.

2. The apparatus of claim 1 wherein at least a portion of the at least one round member comprises a curved surface contacting at least one of the stabilizer sleeve and the at least one round cavity.

3. The apparatus of claim 1 wherein the at least one first round cavity and the at least one second round cavity are each defined by curved surfaces.

4. The apparatus of claim 1 wherein the stabilizer assembly further comprises at least one sealing member disposed within the at least one second round cavity and contacting the at least one round member.

5. The apparatus of claim 1 wherein the stabilizer assembly further comprises a biasing member disposed about the tubular member and axially urging the stabilizer sleeve into contact with the at least one round member.

6. The apparatus of claim 1 wherein:

the tubular member comprises at least one opening in an outer surface of the tubular member; and the stabilizer assembly further comprises at least one additional member disposed within the at least one opening.

7. The apparatus of claim 6 wherein:

the at least one round cavity is at least one first round cavity;

the at least one additional member is a cup comprising a second round cavity; and the at least one round member is at least partially received within the second round cavity.

* * * * *